US011692690B2

(12) United States Patent
De Bevilacqua et al.

(10) Patent No.: US 11,692,690 B2
(45) Date of Patent: Jul. 4, 2023

(54) LIGHTING SYSTEM

(71) Applicant: ARTEMIDE S.P.A., Milan (IT)

(72) Inventors: Carlotta Francesca Isolina Maria De Bevilacqua, Milan (IT); Paolo Leoni, Milan (IT); Laura Pessoni, Milan (IT)

(73) Assignee: ARTEMIDE S.P.A.

( * ) Notice: Subject to any disclaimer, the term of this patent is extended or adjusted under 35 U.S.C. 154(b) by 0 days.

(21) Appl. No.: 17/714,715

(22) Filed: Apr. 6, 2022

(65) Prior Publication Data

US 2022/0325874 A1 Oct. 13, 2022

(30) Foreign Application Priority Data

Apr. 9, 2021 (IT) ..... 102021000008942

(51) Int. Cl.

| | |
|---|---|
| ***F21S 2/00*** | (2016.01) |
| ***F21V 21/008*** | (2006.01) |
| ***F21V 21/16*** | (2006.01) |
| ***F21V 23/00*** | (2015.01) |
| ***F21V 23/02*** | (2006.01) |
| ***F21V 23/04*** | (2006.01) |

(52) U.S. Cl.

CPC ..... *F21V 21/008* (2013.01); *F21V 21/16* (2013.01); *F21V 23/004* (2013.01); *F21V 23/02* (2013.01); *F21V 23/0435* (2013.01)

(58) Field of Classification Search

None

See application file for complete search history.

(56) References Cited

U.S. PATENT DOCUMENTS

| | | | | |
|---|---|---|---|---|
| 5,738,436 | A | 4/1998 | Cummings | |
| 5,788,518 | A * | 8/1998 | Wachter | F21V 21/30 439/121 |
| 10,969,090 | B1 * | 4/2021 | Novakovic | F21V 21/0808 |
| 2002/0064979 | A1 * | 5/2002 | Zakerzewski | F21V 21/26 439/110 |
| 2006/0158882 | A1 | 7/2006 | Klomp et al. | |
| 2018/0299084 | A1 * | 10/2018 | Chien | F21V 13/02 |
| 2019/0341718 | A1 | 11/2019 | Yu | |
| 2020/0112171 | A1 * | 4/2020 | Bogart | H02J 3/14 |

* cited by examiner

*Primary Examiner* — Elmito Breval

(74) *Attorney, Agent, or Firm* — The Belles Group, P.C.

(57) ABSTRACT

A lighting system comprises a support cable having two conductive wires only; a plurality of fastening elements for supporting the cable along a path; a plurality of coupling elements fixable to the cable and having respective pairs of contacts which draw current from the cable; and a plurality of lighting devices coupled to respective coupling elements; each fastening element is provided with a printed circuit board, connected to the contacts and to the lighting device coupled to the fastening element and comprising a DC converter; a dimmer; and a Bluetooth module for receiving and processing signals from an external control device; the board is configured to receive current from the cable and generate a dimmed direct current which supplies the lighting device connected to the board.

11 Claims, 5 Drawing Sheets

LIGHTING SYSTEM

CROSS-REFERENCE TO RELATED APPLICATIONS

This patent application claims priority from Italian patent application no. 102021000008942 filed on Apr. 9, 2021, the entire disclosure of which is incorporated herein by reference.

TECHNICAL FIELD

The present invention relates to a lighting system.

In particular, the invention relates to a suspended, modular lighting system, which can be installed according to different patterns and geometries.

STATE OF THE PRIOR ART

Lighting systems formed by different lighting devices mounted on a track or other support structure in which a power and control cable passes are known.

In some cases, the versatility of the known systems can be limited, i.e. there can be limits as to the spatial shapes and configurations achievable.

Moreover, in the known systems, the devices are connected in series to each other. In order to control the lighting devices independently of one another, it is necessary to use a cable with at least two pairs of conductors (two for the power supply and two for the control).

In general, the known modular lighting systems thus still have margin for improvement, in particular in terms of simplicity of manufacture and assembly and versatility.

OBJECT OF THE INVENTION

It is thus an object of the present invention to provide a lighting system which is particularly easy to manufacture and assemble and which allows preparing a wide variety of different configurations.

The present invention thus relates to a lighting system as defined in essential terms in the appended claim 1 and, in its additional features, in the dependent claims.

The system of the invention is simple to manufacture and install and can be prepared in different spatial configurations, with various shapes and sizes, by further varying the number of lighting devices.

Moreover, the system allows directing and controlling each single lighting device forming part of the system independently of the others, yet using a cable with two conductors only.

The advantages of the system of the invention with respect to the known systems are thus mainly the following:

- possibility of controlling each single lighting device;
- lighting devices connected in parallel and not in series, and thus there are no limits as to the number of lighting devices (except with respect to the total available power);
- possibility of having lighting devices with a high luminous flux;
- possibility of achieving multiple luminous performances;
- possibility of making different strands in space and not just from wall to wall, and not necessarily in coplanar positions.

BRIEF DESCRIPTION OF THE DRAWINGS

Further features and advantages of the present invention will be clear from the description of the following non-limiting example embodiments, with reference to the accompanying figures, wherein.

PREFERRED EMBODIMENT OF THE INVENTION

Figure 1:
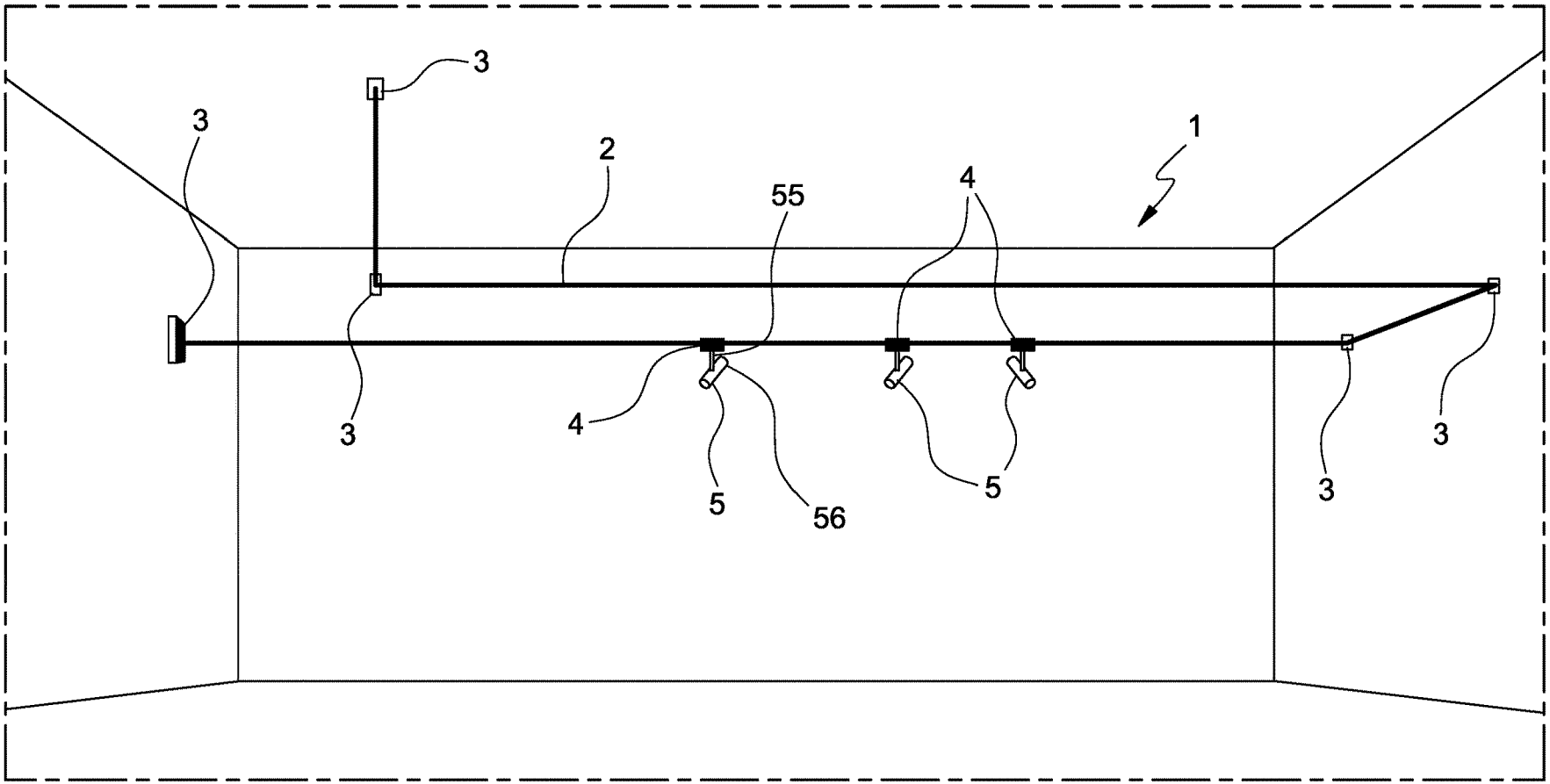
FIG. 1 is a schematic perspective view of a lighting system in accordance with the invention, prepared in an exemplifying configuration.

With reference to FIG. 1, a lighting system 1 comprises a support cable 2; a plurality of fastening elements 3 for supporting the cable 2 along a path, i.e. in a certain spatial configuration also three-dimensional; a plurality of coupling elements 4 which can be fixed to the cable 2; and a plurality of lighting devices 5 which are coupled to respective coupling elements 4.

Figure 2:
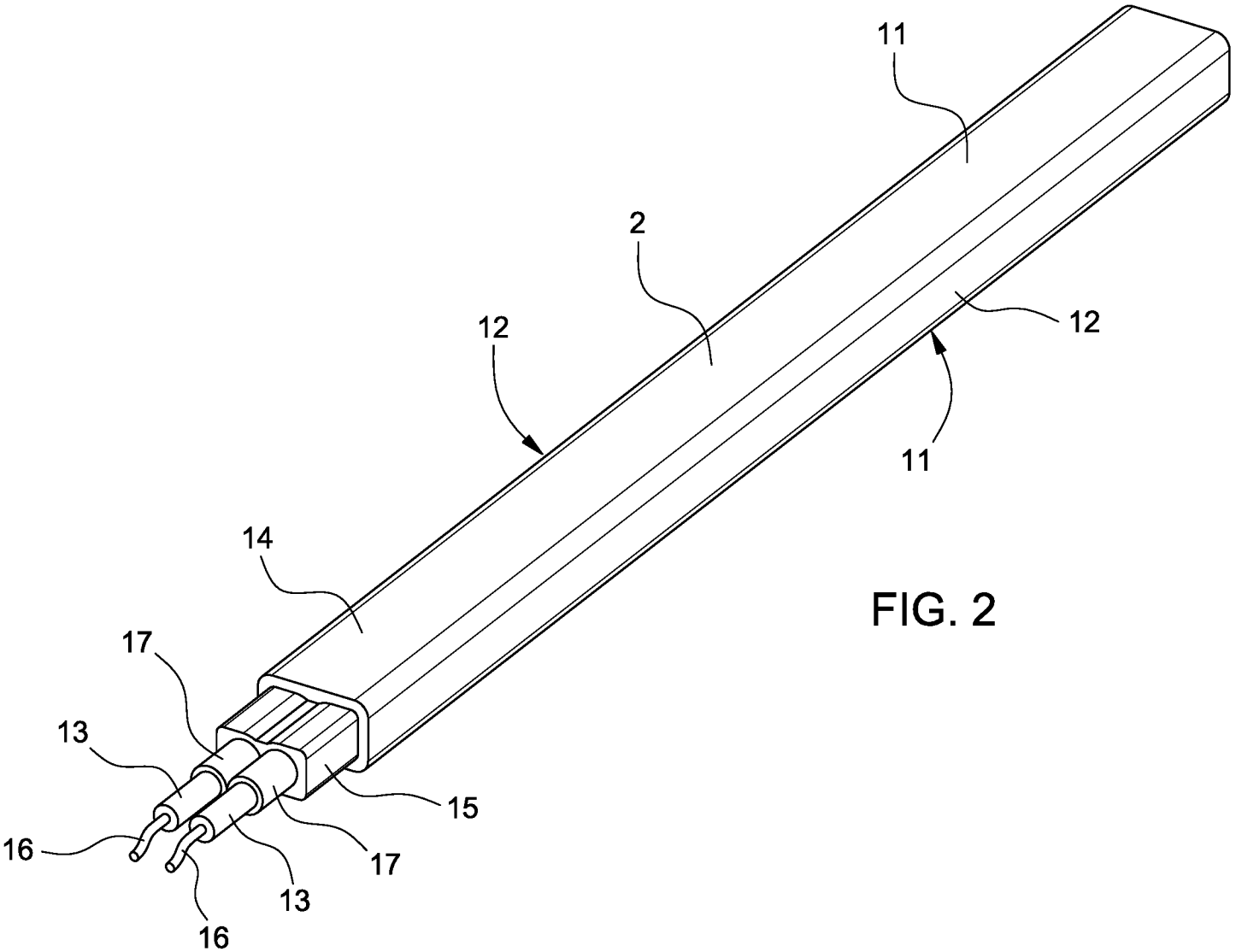
FIG. 2 is a partial schematic perspective view, with parts removed for clarity, of a component of the system of FIG. 1, in particular a support cable.

With specific reference to FIG. 2, the support cable 2 is a flat cable, in particular a cable with a substantially rectangular cross-section (optionally with bevelled and/or rounded edges); the cable 2 has a pair of larger sides 11 and a pair of smaller sides 12, having a width less than the width of the larger sides 11.

The cable 2 comprises a pair of conductive wires 13 arranged longitudinally parallel and side by side; an outer covering sheath 14 which envelops the conductive wires 13; and a filler material 15 positioned between the conductive wires 13 and the sheath 14.

Each conductive wire 13 is formed by a plurality of strands of conductive material (for example made of copper) and is associated with a reinforcement rope 16, made for example of aramid fibres (Kevlar); an insulation layer 17 made of an insulating material, for example polymeric material, covers the conductive wire 13 and the reinforcement rope 16. The reinforcement rope 16 can be on the inside of the conductive wire 13, or on the outside, for example placed next to the respective conductive wire 13. In the illustrated non-limiting example, but not necessarily, each conductive wire 13 is formed by a plurality of strands made of conductive material enveloped about a central reinforcement rope 16.

Preferably, the reinforcement rope 16 is formed by a plurality of threads made of a reinforcing material, for example aramid fibre, wound on each other.

The outer sheath 14 is made of, for example, a cured thermoplastic elastomer; the filler material 15 is, for example, a thermoplastic elastomer, in particular natural rubber, and occupies the space between the conductive wires 13 and the sheath 14.

The fastening elements 3 serve to fix the cable 2 to walls or other surfaces of the environment in which the system 1 is installed and to define a predefined path for the cable 2.

Figure 3:
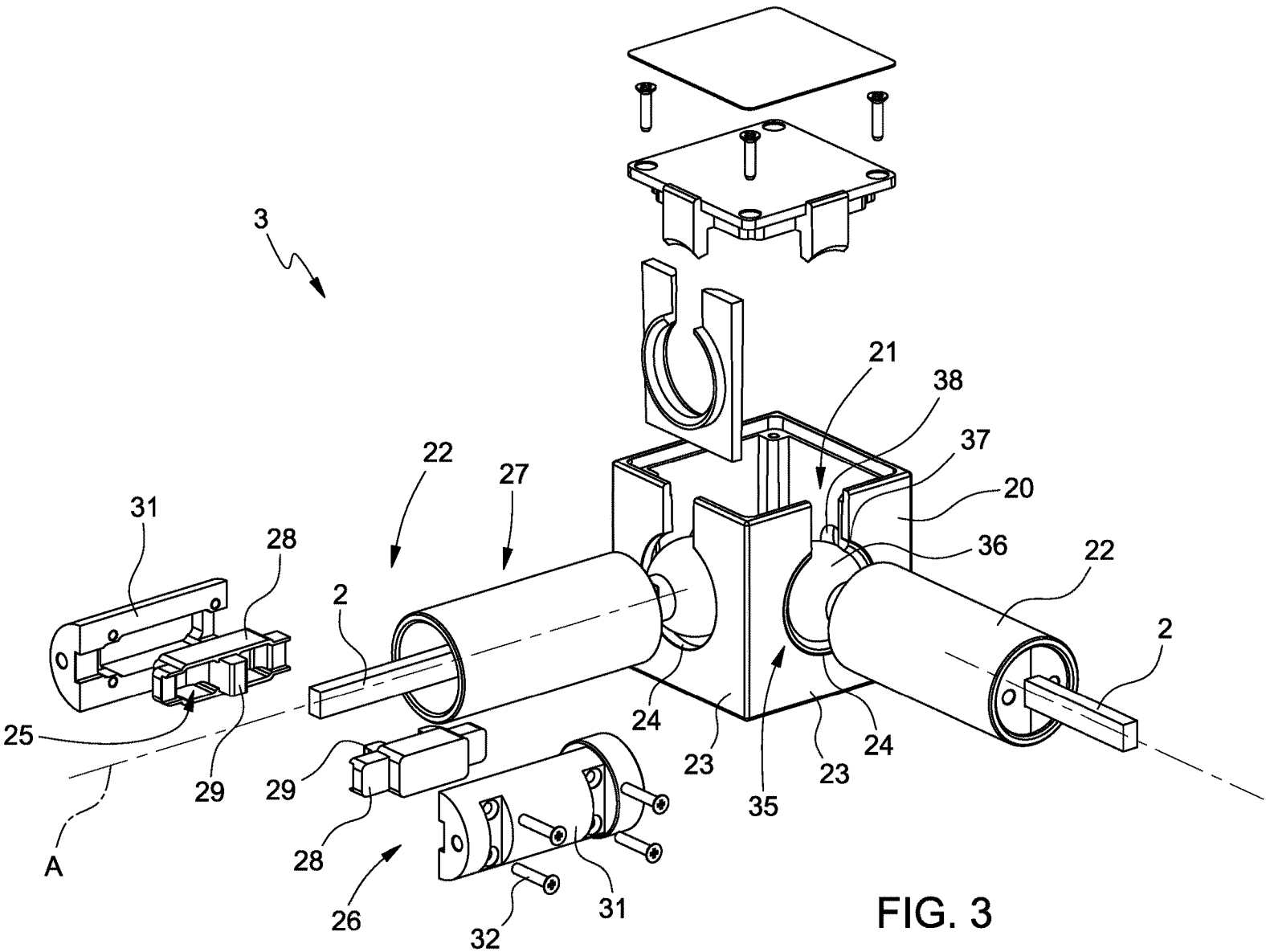
FIG. 3 is a partially exploded perspective view of a further component of the system of FIG. 1, in particular a fastening element.

With reference to FIG. 3, each fastening element 3 comprises an internally hollow body 20, having an inner seat 21 for housing a portion of the cable 2; and at least one tensioner assembly 22 supported by the body.

In the illustrated non-limiting example, the fastening element 3 comprises a pair of tensioner assemblies 22 projecting from respective faces 23 of the body 20, for example adjacent to each other. The faces 23 of the body 20 are provided with respective through-openings 24, through which the cable 2 can be inserted, which can thus be arranged bent through the body 20, exiting from both openings 24.

A tensioner assembly 22 is associated with each opening 24.

It is understood that the body 20 can have a shape different from the one described and illustrated herein merely by way of example and have openings 24 placed in various ways on the body 20; any openings 24 not associated with respective tensioner assemblies 22 can be closed by plugs (not illustrated).

Figure 4:
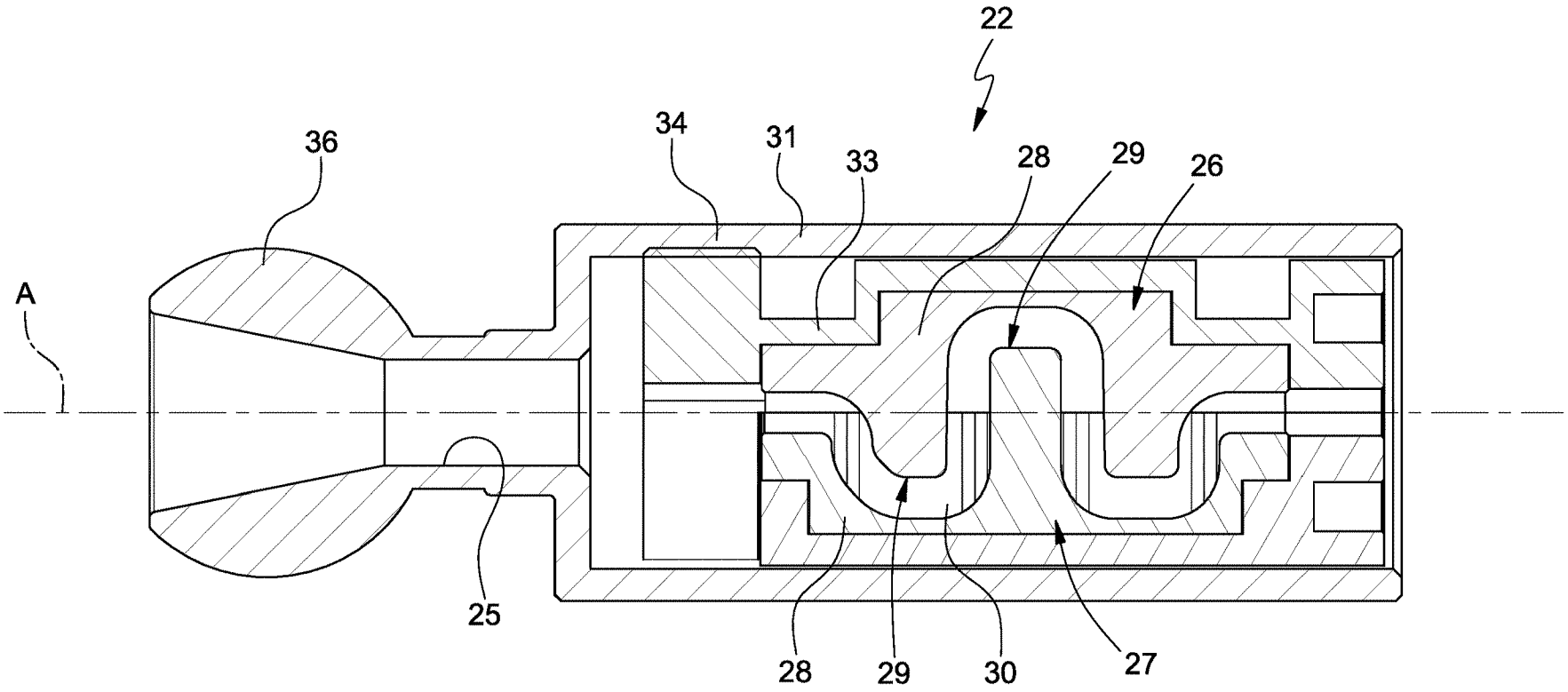
FIG. 4 is a longitudinal sectional view, with parts removed for clarity, of a detail of the component of FIG. 3.

With reference also to FIG. 4, the tensioner assembly 22 extends along a longitudinal axis A and is internally provided with an inner channel 25 extending along the axis A and in which the cable 2 is fitted.

The tensioner assembly 22 comprises a cable clamp 26 and a tensioning device 27 acting on the cable 2 in order to clamp the cable 2 transversally and tighten the cable 2 longitudinally.

The cable clamp 26 comprises a pair of pads 28 facing each other and having respective opposite contact surfaces 29, shaped to define a passage 30, preferably serpentine-shaped, inside the channel 25 and in which the cable 2 is fitted. The pads 28 are pressed against each other by respective outer shells 31, joined to each other by means of, for example, clamping screws 32 (or other equivalent clamping members). By tightening the clamping screws 32, the shells 31 tighten the respective pads 28 against each other locking the cable 2 in the passage 30 between the contact surfaces 29.

The passage 30 is shaped so as to receive the cable 2 with the respective larger sides 11 facing and parallel to the contact surfaces 29.

The tensioning device 27 is, for example, a screw tensioning device, comprising an inner male member 33 and an outer female member 34, screwed together by rotation about the axis A; the cable clamp 26 is housed inside the female member 34 and is freely rotatable about the axis A with respect to the female member 34 so as to translate along the axis A together with the male member 33 when the female member 34 is screwed onto the male member 33; the relative rotation between the male member 33 and the female member 34 causes a translation along the axis A of the cable clamp 26.

Advantageously, the tensioner assembly 22 is coupled to the body 20 by means of a rotating joint 35, in particular a ball joint, such that the tensioner assembly 22 can be oriented with respect to the body 20. The joint 35 is defined in particular by a spherical head 36 (i.e. shaped like a portion of a spherical cap), which projects from one end of the tensioner assembly 22, and by a rotation seat 37 formed around the opening 24 of the body 20 and housing the head 36.

The body 20 is provided with fastening seats or members 38 for fixing or suspending the fastening element 3 to or from a support surface, for example holes formed in respective walls of the body 2 for receiving screws, a suspension cable or tie rod, etc.

Figure 5:
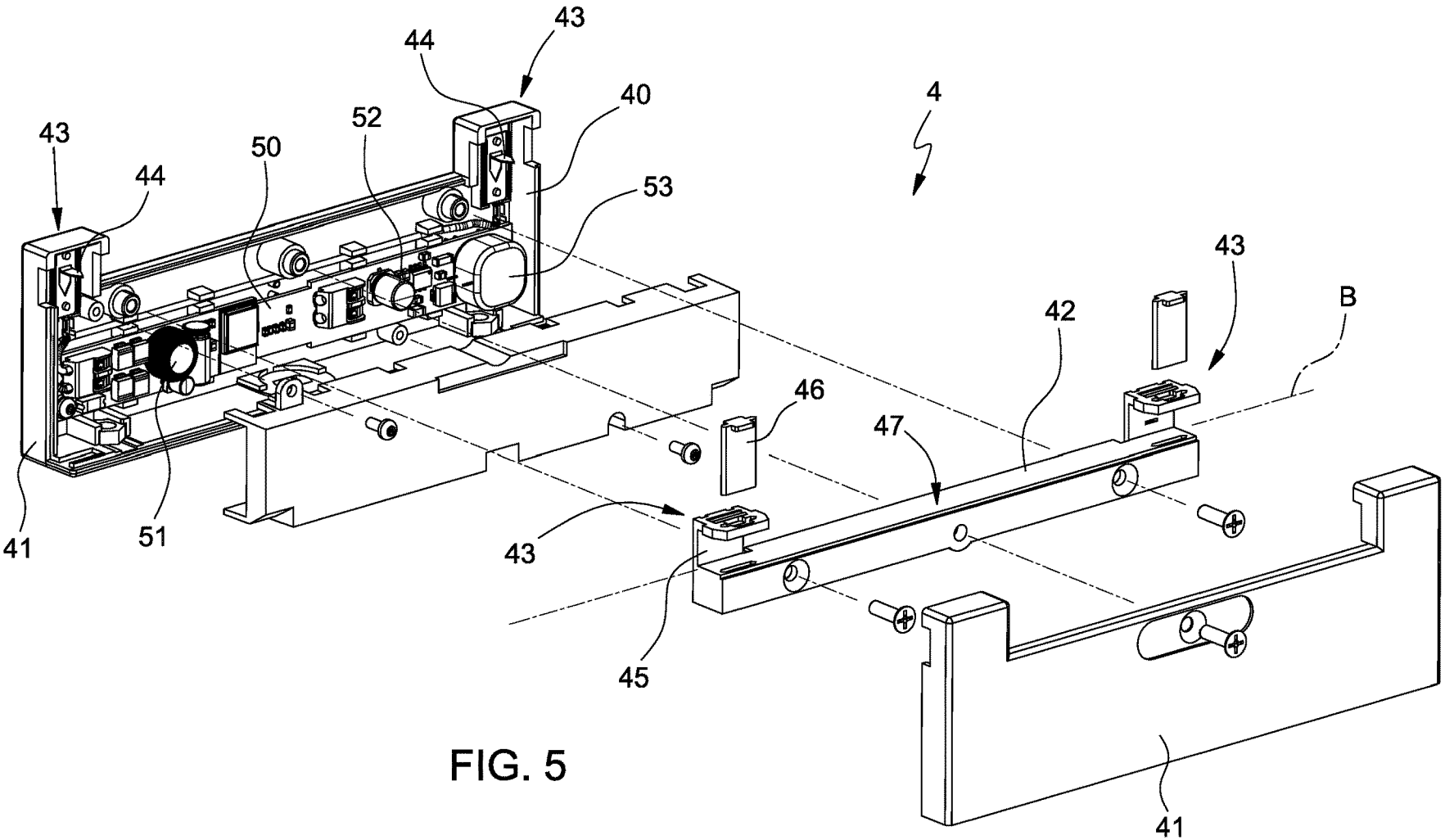
FIG. 5 is an exploded perspective view of a further component of the system of FIG. 1, in particular a coupling element for a lighting device.

With reference to FIG. 5, the coupling element 4 comprises a casing 40, for example formed by two half-shells 41 coupled to each other, provided with a guide 42 which extends along an axis B and receives the cable 2.

The guide 42 comprises in particular clips 43 projecting from the casing 40 to engage the cable 2 and are provided with respective electrical contacts 44 for contacting the cable 2.

In particular, the coupling element 4 has a pair of clips 43 located at respective longitudinal ends of the coupling element 4 and aligned with each other.

Each clip 43 is formed by two opposite facing arms 45, 46, which can be separated or opened for inserting the cable 2.

Each clip 43 is provided with a contact 44 which projects from an arm 45 of the clip 43 towards the opposite arm 46. In the illustrated example, but not necessarily, the contacts 44 pass through respective slots obtained in the arms 45 of the clips 43.

Preferably, each contact 44 has a sharp free end.

The guide 42 has a bottom wall 47 which supports the cable 2 and from which the clips 43 project.

The clips 43 are shaped so as to receive the cable 2 with the larger sides 11 facing respective arms 45, 46 of the clips 43; and with the smaller sides 12 parallel to the bottom wall 47.

The cable 2 is placed on the guide 42 and is engaged by the clips 43, being clamped between the arms 45, 46 of each clip 43. The cable 2 can be inserted laterally into the guide 42, for example by separating the two half-shells 41 of the casing and/or by opening the clips 43. In the present case, each clip 43 can be opened by extracting the arm 46 from its seat 48 formed on the guide 42. By closing the two half-shells 41 and the clips 43, the clips 43 clamp the cable 2 in the guide 42 locking the coupling element 4 with respect to the cable 2.

The closing of the clips 43 also causes the contacts 44 to penetrate the cable 2, perforating in particular the sheath 14 and the filler material 15 in order to contact the conductive wires 13. To such end, the contacts 44 are arranged offset relative to each other perpendicularly to the bottom wall 47 of the guide 42 (i.e. they are placed at different distances from the bottom wall 47).

The casing 40 houses a printed circuit board 50 (PCB), which is connected to the contacts 44 and to the lighting device 5 connected to the fastening element 4.

The board 50 comprises a DC converter 51, i.e. a circuit that converts a source of direct current from one voltage to another; a dimmer 52, for adjusting the power transferred to the output of the board 50; and a Bluetooth module 53, configured to receive and process signals from an external control device, which can be a dedicated control device or be integrated in a portable electronic device such as a smartphone, tablet, etc.

The board 50 is configured to receive a direct current from the cable 2 at a predetermined input voltage, via the contacts 44, and to generate a dimmed direct current at an output voltage (different from the input voltage), which supplies the lighting device 5 connected to the board 50.

In particular, the board 50, thanks to the Bluetooth module 53 which controls the dimmer 52, is configured to adjust the power transferred to the lighting device 5 for piloting the lighting device 5.

The lighting device 5 can be of various types. In general (FIG. 1), the lighting device 5 comprises a stem 55 which projects from the coupling element 4 and is fixed to the coupling element 4, optionally by means of an orientable joint; and an illuminating head 56, provided with at least one light source and optionally with an optical unit associated with the light source.

The lighting device 5 is connected to the board 50 by means of a pair of electric wires.

In use, the system 1 can be variously configured in space, thus assuming different shapes and extents.

The fastening elements 3 are fixed at predetermined positions on the supporting surfaces (for example on walls, floors, ceilings, etc.) or suspended from the same, and the cable 2 is inserted through the various fastening elements 3.

Thanks to the joints 35, the cable 2 can enter and exit each fastening element 3 in various configurations and according to various orientations.

The lighting devices 5 are then mounted on the cable 2, the lighting devices 5 being borne by respective coupling elements 4, in the desired positions along the cable 2, possibly choosing lighting devices 5 of different types.

Each lighting device 5 is coupled to the cable 2 by means of the respective coupling element 2, which is opened in order to insert the cable 2 into the guide 42 and in the clips 43 and then closed again so that the clips 43 clamp the cable 2 and the contacts 44 establish the electrical contact with the conductive wires 13. As they are offset in relation to one another perpendicularly to the bottom wall of the guide 42, the contacts 44 contact respective conductive wires 13.

With only two conductive wires 13 (positive and negative), the system 1 is capable of mounting any number of lighting devices 5, each of which can be controlled independently.

In fact, all the lighting devices 5 of the system 1 receive current from the cable 2, via the respective boards 50. The board 50 of each coupling element 4, connected to a respective lighting device 5, then receives the control signal via the Bluetooth module 53.

Finally, it is understood that the lighting system described and illustrated herein can be subject to further modifications and variations which do not depart from the scope of the appended claims.

The invention claimed is:

1. A lighting system (1) comprising a flat support cable (2) with a substantially rectangular cross-section, having two conductive wires (13) only, arranged longitudinally parallel to each other and covered by a covering sheath (14) which envelops the conductive wires (13) with a filler material (15) positioned between the conductive wires (13) and the sheath (14); a plurality of fastening elements (3) for supporting the cable (2) along a path; a plurality of coupling elements (4) fixable to the cable (2) and having respective pairs of contacts (44) which draw current from the cable (2); and a plurality of lighting devices (5) coupled to respective coupling elements (4); coupling element (4) being provided with a printed circuit board (50), connected to the contacts (44) and to the lighting device (5) coupled to the coupling element (4); the system (1) being characterized in that the board (50) comprises a DC converter (51); a dimmer (52); and a Bluetooth module (53) for receiving and processing signals from an external control device; the board (50) being configured to receive a direct current from the cable (2) at an input voltage, via the two pairs of contacts (44), and to generate a dimmed direct current at an output voltage, different from the input voltage, which supplies the lighting device (5) connected to the board (50); and wherein each coupling element (4) comprises a casing (40) provided with a guide (42) which extends along an axis (B) and receives the cable (2); and wherein the guide (42) has a bottom wall (47) which supports the cable (2), and a pair of clips (43), located at respective longitudinal ends of the coupling element (4) and aligned with each other and projecting from the bottom wall (47) to engage the cable (2) and provided with respective electric contacts (44) for contacting the cable (2); each clip (43) being formed by two opposite facing arms (45, 46), which can be separated or opened for inserting the cable (2) and the cable (2) being clamped between respective opposite arms (45, 46) of each clip (43), which clamp the cable (2) in the guide (42) locking the coupling element (4) with respect to the cable (2) and also causes the contacts (44) to penetrate the cable (2), perforating the sheath (14) and the filler material (15) in order to contact the conductive wires (13); and wherein the contacts (44) are arranged offset relative to each other perpendicularly to the bottom wall (47) of the guide (42), being placed at different distances from the bottom wall (47).

2. A system according to claim 1, wherein each board (50) is configured to adjust the power transferred to the respective lighting device (5) for piloting the lighting device (5) independently of the other lighting devices (5) of the system (1).

3. A system according to claim 1, wherein each fastening element (3) comprises an internally hollow body (20), having an inner seat (21) for housing a portion of the cable (2); and at least one tensioner assembly (22) supported by the body (20) and extending along a longitudinal axis (A) and internally provided with an inner channel (25) extending along the axis (A) and in which the cable (2) is fitted.

4. A system according to claim 3, wherein the tensioner assembly (22) comprises a cable clamp (26) and a tensioning device (27) acting on the cable (2) to clamp and tighten the cable (2).

5. A system according to claim 4, wherein the cable clamp (26) comprises a pair of pads (28) facing each other and having respective contact surfaces (29) shaped to define a serpentine-shaped passage (30), in which the cable (2) is fitted; the pads being pressed against each other by respective shells (31), joined to each other.

6. A system according to claim 4, wherein the tensioning device (27) is a screw tensioning device, comprising an inner male member (33) and an outer female member (34), screwed together by rotation about the axis (A).

7. A system according to claim 3, wherein the tensioner assembly (22) is coupled to the body (20) via a ball joint (35).

8. A system according to claim 3, wherein the fastening element (3) comprises a pair of tensioner assemblies (22) projecting from respective faces (23) of the body (20).

9. A system according to claim 1, wherein the casing (40) is formed by two half-shells (41) joined to each other.

10. A system according to claim 1, wherein each clip (43) is provided with a contact (44) projecting from an arm (45) of the clip (43) towards the opposite arm (46) and having a sharp free end.

11. A system according to claim 1, wherein each conductive wire (13) is associated to a reinforcement rope (16) and is covered by an insulation layer (17) made of an insulating material.

* * * * *